US005999897A

United States Patent [19]

Yeldener

[11] Patent Number: 5,999,897

[45] Date of Patent: Dec. 7, 1999

[54] METHOD AND APPARATUS FOR PITCH ESTIMATION USING PERCEPTION BASED ANALYSIS BY SYNTHESIS

[75] Inventor: Suat Yeldener, Ellicott City, Md.

[73] Assignee: Comsat Corporation, Bethesda, Md.

[21] Appl. No.: 08/970,396

[22] Filed: Nov. 14, 1997

[51] Int. Cl.[6] ..... G10L 7/00

[52] U.S. Cl. ..... 704/207; 704/220

[58] Field of Search ..... 704/225, 221, 704/223, 219, 205, 206, 207, 208, 209, 220

[56] References Cited

U.S. PATENT DOCUMENTS

| | | | |
|---|---|---|---|
| 4,937,868 | 6/1990 | Taguchi | 704/207 |
| 4,980,916 | 12/1990 | Zinser . | |
| 4,989,247 | 1/1991 | Hemert . | |
| 5,216,747 | 6/1993 | Hardwick et al. . | |
| 5,226,108 | 7/1993 | Hardwick et al. . | |
| 5,327,518 | 7/1994 | George et al. | 704/261 |
| 5,473,727 | 12/1995 | Nishiguchi et al. . | |
| 5,548,680 | 8/1996 | Cellario . | |
| 5,579,433 | 11/1996 | Jarvinen . | |
| 5,581,656 | 12/1996 | Hardwick et al. . | |
| 5,596,676 | 1/1997 | Swaminathan et al. . | |
| 5,596,677 | 1/1997 | Jarvinen et al. . | |
| 5,630,012 | 5/1997 | Nishiguchi et al. . | |
| 5,666,464 | 9/1997 | Serizawa | 704/223 |

OTHER PUBLICATIONS

Parsons "Voice and Speech Processing"McGraw Hill p. 350.

*Primary Examiner*—David R. Hudspeth
*Assistant Examiner*—Harold Zintel
*Attorney, Agent, or Firm*—Sughrue, Mion, Zinn, Macpeak & Seas, PLLC

[57] ABSTRACT

The present invention provides a method for pitch estimation which utilizes perception based analysis by synthesis for improved pitch estimation over a variety of input speech conditions. Initially, pitch candidates are generated corresponding to a plurality of sub-ranges within a pitch search range. Then a residual spectrum is determined for a segment of speech and a reference speech signal is generated from the residual spectrum using sinusoidal synthesis and linear predictive coding (LPC) synthesis. A synthetic speech signal is generated for each of the pitch candidates using sinusoidal and LPC synthesis. Finally, the synthetic speech signal for each pitch candidate is compared with the reference residual signal to determine an optimal pitch estimate based on a pitch period of a synthetic speech signal that provides a maximum signal to noise ratio.

8 Claims, 3 Drawing Sheets

METHOD AND APPARATUS FOR PITCH ESTIMATION USING PERCEPTION BASED ANALYSIS BY SYNTHESIS

FIELD OF THE INVENTION

The present invention relates to a method of pitch estimation for speech coding. More particularly, the present invention relates to a method of pitch estimation which utilizes perception based analysis by synthesis for improved pitch estimation over a variety of input speech conditions.

BACKGROUND OF THE INVENTION

An accurate representation of voiced or mixed type of speech signals is essential for synthesizing very high quality speech at low bit rates (4.8 kbit/s and below). For bit rates of 4.8 kbit/s and below, conventional Code Excited Linear Prediction (CELP) does not provide the appropriate degree of periodicity. The small code-book size and coarse quantization of gain factors at these rates result in large spectral fluctuations between the pitch harmonics. Alternative speech coding algorithms to CELP are the Harmonic type techniques. However, these techniques require a robust pitch algorithm to produce a high quality speech. Therefore, one of the most prevalent features in speech signals is the periodicity of voiced speech known as pitch. The pitch contribution is very significant in terms of the natural quality of speech.

Although many different pitch estimation methods have been developed, pitch estimation still remains one of the most difficult problems in speech processing. That is, conventional pitch estimation algorithms fail to produce a robust performance over variety input conditions. This is because speech signals are not perfectly periodic signals, as assumed. Rather, speech signals are quasi-periodic or non-stationary signals. As a result, each pitch estimation method has some advantages over the others. Although some pitch estimation methods produce good performance for some input conditions, none overcome the pitch estimation problem for a variety input speech conditions.

SUMMARY OF THE INVENTION

According to the invention, a method is provided for estimating pitch of a speech signal using perception based analysis by synthesis which provides a very robust performance and is independent of the input speech signals.

Initially, a pitch search range is partitioned into sub-ranges and pitch candidates are determined for each of the sub-ranges. After pitch candidates are selected, and Analysis by Synthesis error minimization procedure is applied to chose an optimal pitch estimate from the pitch candidates.

First, a segment of speech is analyzed using linear predictive coding (LPC) to obtain LPC filter coefficients for the block of speech. The segment of speech is then LPC inverse filtered using the LPC filter coefficients to provide a spectrally flat residual signal. The residual signal is then multiplied by a window function and transformed into the frequency domain using either DFT or FFT to obtain a residual spectrum. Next, using peak picking the residual spectrum is analyzed to obtain the peak amplitudes, frequencies and phases of the residual spectrum. These components are used to generate a reference residual signal using a sinusoidal synthesis. Using LPC synthesis, a reference speech signal is generated from the reference residual signal.

For each candidate of pitch, the spectral shape of the residual spectrum is sampled at the harmonics of the pitch candidate to obtain the harmonic amplitudes, frequencies and phases. Using sinusoidal synthesis, the harmonic components for each pitch candidate are used to generate a synthetic residual signal for each pitch candidate based on the assumption that the speech is purely voiced. The synthetic residual signals for each pitch candidate are then LPC synthesis filtered to generate synthetic speech signals corresponding to each candidate of pitch. The generated synthetic speech signals for each pitch candidate are then compared with the reference residual signal, to determine the optimal pitch estimate based on the synthetic speech signal for the pitch candidate that provides the maximum signal to noise ratio minimum error.

BRIEF DESCRIPTION OF THE DRAWINGS

Below the present invention is described in detail with reference to the enclosed figures, in which.

DETAILED DESCRIPTION OF THE INVENTION

Figure 1:
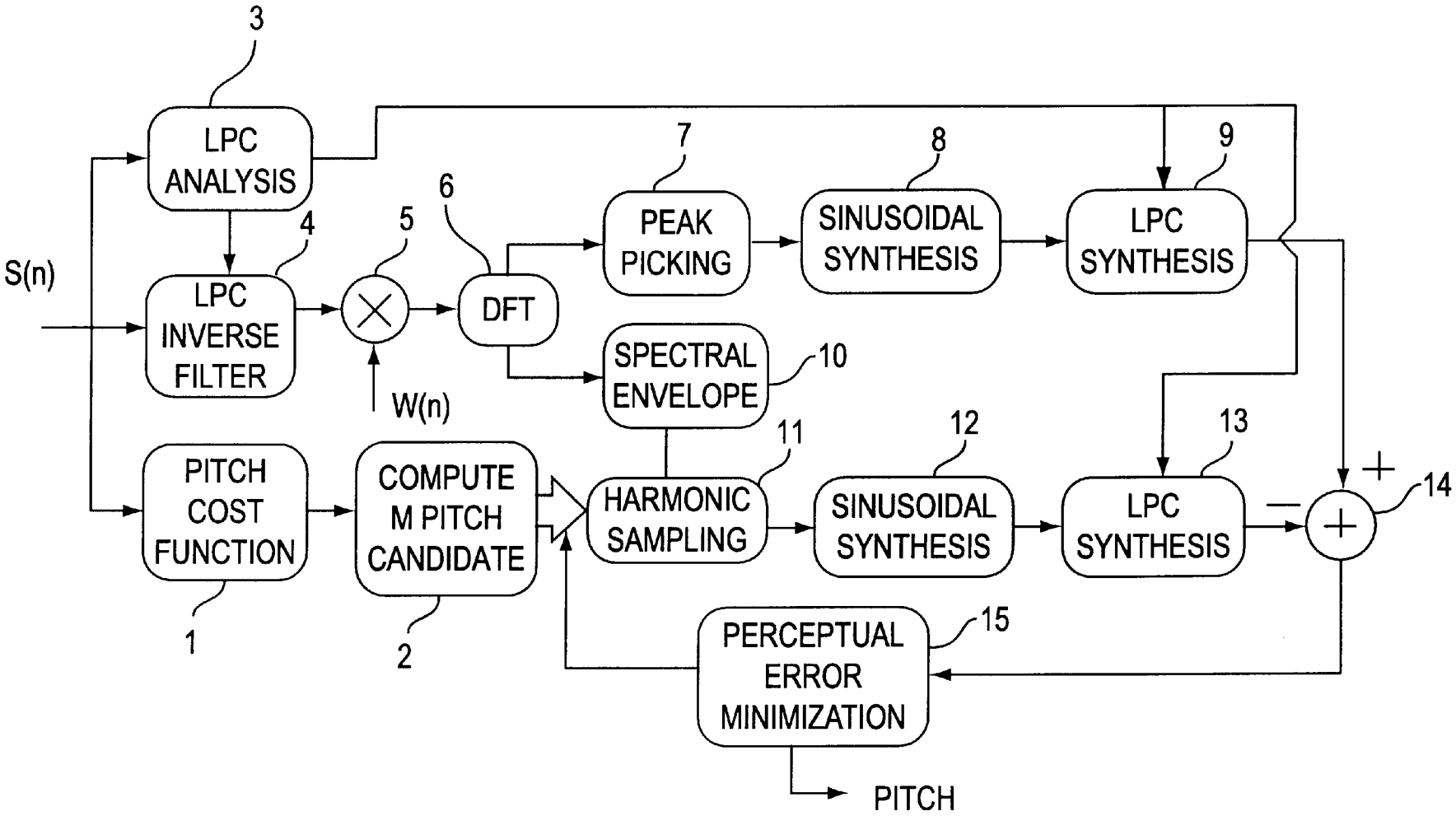
FIG. 1 is block diagram of the perception based analysis by synthesis algorithm.

FIG. 1 shows a block diagram of the perception based analysis by synthesis method. An input speech sign S(n) is provided to an pitch cost function section 1 where a pitch cost function is computed for an pitch search range and the pitch search range is partitioned into M sub-ranges. In the preferred embodiment, partitioning is performed using uniform sub-ranges in log domain which provides for shorter sub-ranges for shorter pitch values and longer sub-ranges for longer pitch periods. However, those skilled in the art will recognize that many rules to divide the pitch search range into M sub ranges can be used. Likewise, many pitch cost functions have been developed and any cost function can be used to obtain the initial pitch candidates for each sub-range. In the preferred embodiment, the pitch cost function is a frequency domain approach developed by McAulay and Quatieri (R. J. McAulay, T. F. Quatieri "Pitch Estimation and Voicing Detection Based on Sinusoidal Speech Model" Proc. ICASSP, 1990, pp.249–252) which is expressed as follows:

$$C(\omega_0) = \sum_{j=1}^{H} |S(j\omega_0)| \left\{ \max[M_1 D(\omega_1 - j\omega_0)] - \frac{1}{2}|S(j\omega_0)| \right\}$$

where $\omega_o$ are the possible fundamental frequency candidates, $|S(j\omega_o)|$ are the harmonic magnitudes, $M_l$ and $\omega_l$ are the peak magnitudes and frequencies, respectively, and D(x)=sin(x), and H is the number of harmonics corresponding to the fundamental frequency candidate, $\omega_o$. The pitch cost function is then evaluated for each of the M sub-ranges in a compute pitch candidate section 2 to obtain a pitch candidate for each of the M sub-ranges.

After pitch candidates are determined, an Analysis By Synthesis error minimization procedure is applied to chose the most optimal pitch estimate. First, a segment of speech signal S(n) is analyzed in an LPC analysis section 3 where linear predicitive coding (LPC) is used to obtain LPC filter coefficients for the segment of speech. The segment of speech is then passed through an LPC inverse filter 4 using the estimated LPC filter coefficients in order to provide a residual signal which is spectrally flat. The residual signal is then multiplied by a window function W(n) at multiplier 5 and transformed into the frequency domain to provide a residual spectrum using either DFT (or FFT) in a DFT section 6. Next, in peak picking section 7, the residual spectrum is analyzed to determine the peak amplitudes and corresponding frequencies and phases. In a sinusoidal synthesis section, the peak components are used to generate a reference residual (excitation) signal which is defined by:

$$r(n) = \sum_{p=1}^{L} A_p \cos(n\omega_p + \theta_p)$$

where L is number of peaks in the residual spectrum, and $A_p$, $\omega_p$, and $\theta_p$ are the $p^{th}$ peak magnitudes, frequencies and phases respectively.

The reference residual signal is then passed through an LPC synthesis filter 9 to obtain a reference speech signal.

In order to obtain the harmonic amplitudes for each candidate of pitch, the envelope or spectral shape of the residual spectrum is calculated in a spectral envelope section 10. For each candidate of pitch, the envelope of the residual spectrum is sampled at the harmonics of the corresponding pitch candidate to determine the harmonic amplitudes and phases for each pitch candidate in a harmonic sampling section 11. These harmonic components are provided to a sinusoidal synthesis section 12 where they are used to generate a harmonic synthetic residual (excitation) signal for each pitch candidate based on the assumption that the speech signal is purely voiced. The synthetic residual signal can be formulated as:

$$\hat{r}(n) = \sum_{h=1}^{H} M_h \cos(nh\omega_p + \theta_h)$$

where H is number harmonics in the residual spectrum, and $M_h$, $\omega_o$, and $\theta_h$ are the $p^{th}$ harmonic magnitudes, candidate fundamental frequency and harmonic phases respectively. The synthetic residual signal for each pitch candidate is then passed through a LPC synthesis filter 13 to obtain a synthetic speech signal for each pitch candidate. This process is repeated for each candidate of pitch, and a synthetic speech signal corresponding to each candidate of pitch is generated. Each of the synthetic speech signals are then compared with the reference signal in an adder 14 to obtain a signal to noise ratio for each of the synthetic speech signals. Lastly, the pitch candidate having a synthetic speech signal that provides the minimum error or maximum signal to noise ratio, is chosen as the optimal pitch estimate in a perceptual error minimization section 15.

During the error minimization process carried out by the error minimization section 15, a formant weighting as in CELP type coders, is used to emphasize the formant frequencies rather than the formant nulls since formant regions are more important than the other frequencies. Furthermore, during sinusoidal synthesis another amplitude weighting function is used which provides more attention to the low frequency components than the high frequency components since the low frequency components are perceptually more important than the high frequency components.

Figure 2A:
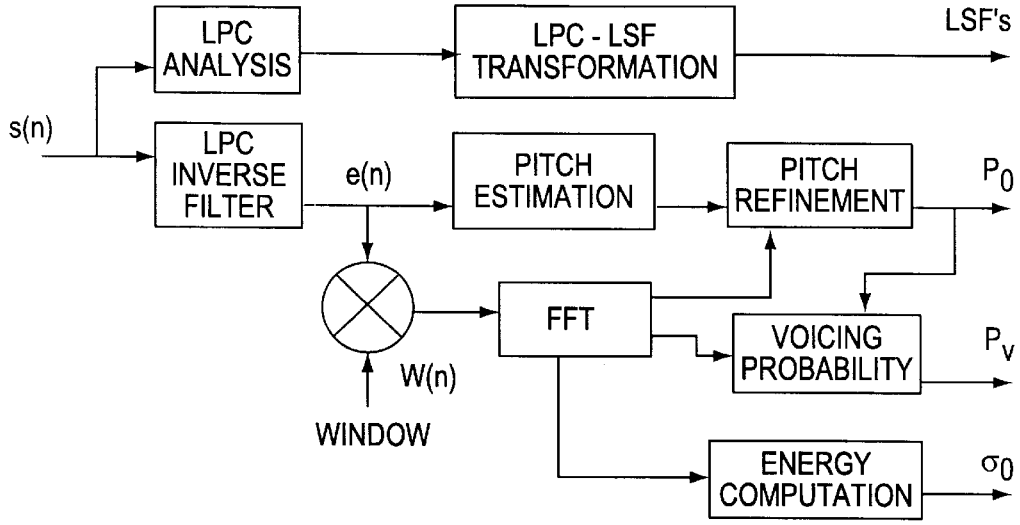
FIGS. 2A and 2B are a block diagrams of a speech encoder and decoder, respectively, embodying the method of the present invention.
Figure 2B:
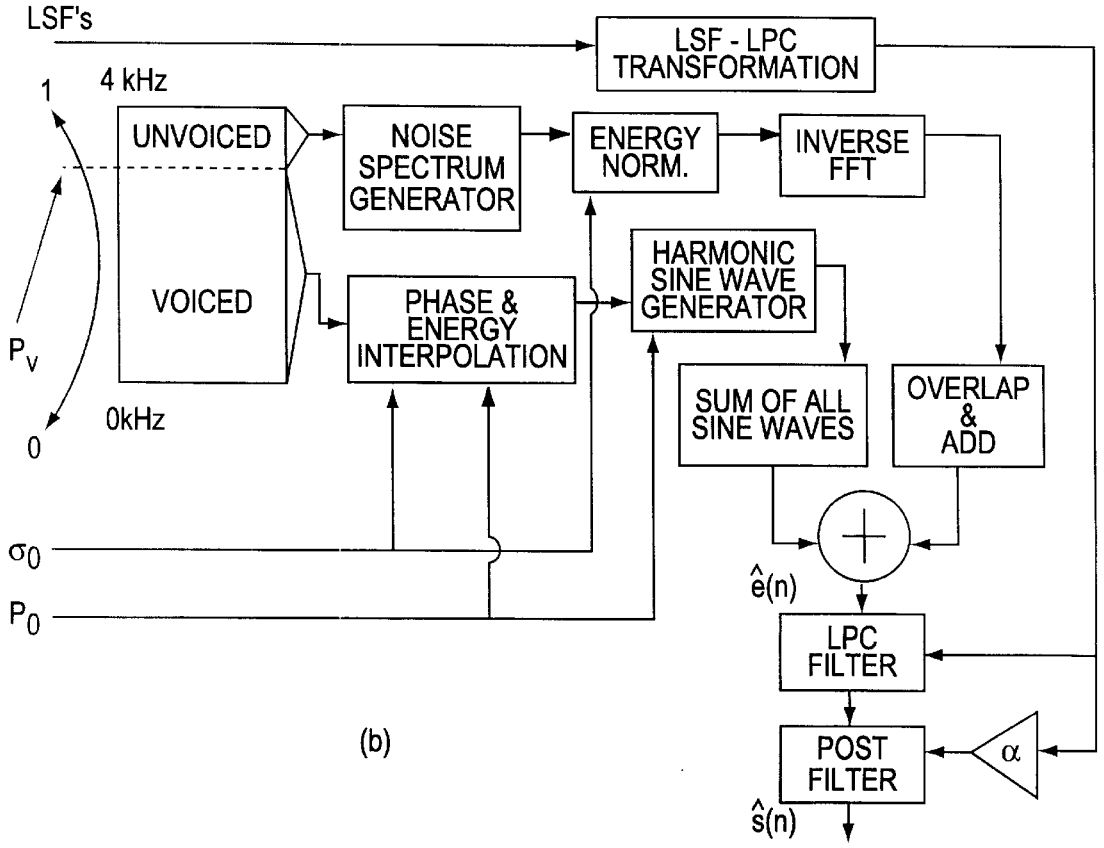

In one embodiment, the above described method of pitch estimation is utilized in a Harmonic Excited Linear Predictive Coder (HE-LPC) as shown in the block diagrams of FIGS. 2A and 2B. In the HE-LPC encoder (FIG. 2A), the approach to representing a speech signal s(n)_ is to use a speech production model where speech is formed as the result of passing an excitation signal e(n) through a linear time varying LPC inverse filter, that models the resonant characteristics of the speech spectral envelope. The LPC inverse filter is represented by ten LPC coefficients which are quantized in the form of line spectral frequency (LSF).

In the HE-LPC, the excitation signal e(n) is specified by the fundamental frequency, it energy $\sigma_o$ and a voicing probability $P_v$ that defines a cut-off frequency ($\omega_c$)—assuming the LPC excitation spectrum is flat. Although the excitation spectrum has been assumed to be flat where LPC is perfect model and provides an energy level throughout the entire speech spectrum, the LPC is not necessarily a perfect model since it does not completely remove the speech spectral shape to leave a relatively flat spectrum. Therefore, in order to improve the quality of MHE-LPC speech model, the LPC excitation spectrum is divided into various non-uniform bands (12–16 bands) and an energy level corresponding to each band is computed for the representation of the LPC excitation spectral shape. As a result, the speech quality of the MHE-LPC speech model is improved significantly.

Figure 3:
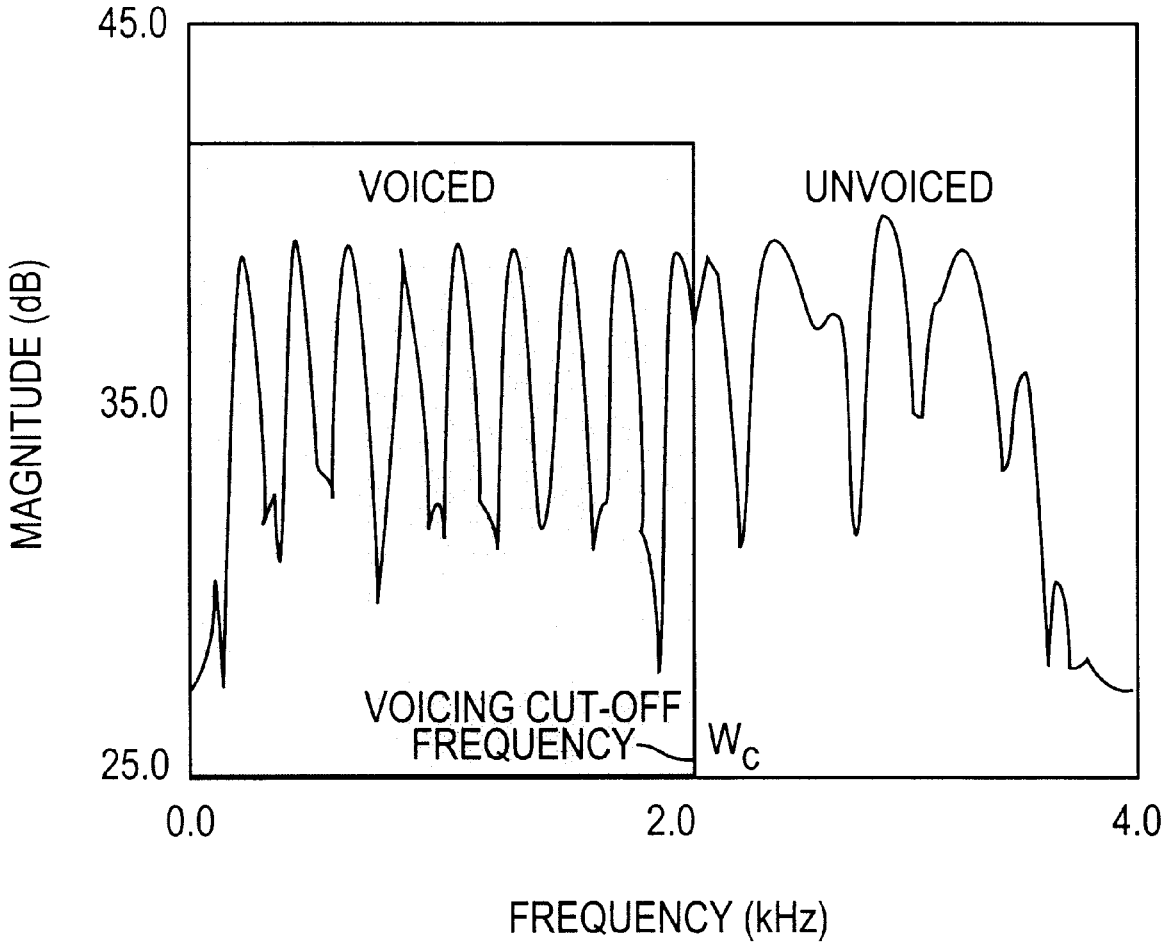
FIG. 3 is a typical LPC excitation spectrum with its cut-off frequency.

FIG. 3 shows a typical residual/excitation spectrum and its cut-off frequency. The cut-off frequency ($\omega_c$) illustrates the voiced (when frequency $\omega<\omega_c$) and unvoiced (when $\omega\geqq\omega_c$) parts of the speech spectrum. In order to estimate the voicing probability of each speech frame, a synthetic excitation spectrum is formed using estimated pitch and harmonic magnitudes of pitch frequency, based on the assumption that the speech signal is purely voiced. The original and synthetic excitation spectra corresponding to each harmonic of fundamental frequency are then compared to find the binary v/uv decision for each harmonic. In this case, when the normalized error over each harmonic is less than a determined threshold, the harmonic is declared to be voiced, otherwise it is declared to be unvoiced. The voicing probability $P_v$ is then determined by the ratio between voiced harmonics and the total number of harmonics within 4 kHz speech bandwidth. The voicing cut-off frequency $\omega_c$ is proportional to voicing and is expressed by the following formula:

$\omega_c=4P_v$ (kHz)

Representing the voicing information using the concept of voicing probability introduced an efficient way to represent the mixed type of speech signals with noticeable improvement in speech quality. Although, multi-band excitation requires many bits to represent the voicing information, since the voicing determination is not perfect model, there may be voicing errors at low frequency bands which introduces noise and artifacts in the synthesized speech. However, using the voicing probability concept as defined above completely eliminates this problem with better efficiency.

At the decoder (FIG. 2B), the voiced part of the excitation spectrum is determined as the sum of harmonic sine waves which fall below the cut-off frequency ($\omega<\omega_c$). The harmonic phases of sine waves are predicted from the previous frame's information. For the unvoiced part of the excitation spectrum, a white random noise spectrum normalized to excitation band energies, is used for the frequency components that fall above the cut-off frequency ($\omega>\omega_c$). The voiced and unvoiced excitation signals are then added together to form the overall synthesized excitation signal. The resultant excitation is then shaped by a linear time-varying LPC filter to form the final synthesized speech. In order to enhance the output speech quality and make it cleaner, a frequency domain post-filter is used. This post-filter causes the formants to narrow and reduces the depth of the formant nulls thereby attenuating the noise in the formant nulls and enhancing the output speech. The post-filter produces good performance over the whole speech spectrum unlike previously reported time-domain post-filters which tend to attenuate the speech signal in the high frequency regions, thereby introducing spectral tilt and hence muffling in the output speech.

Although the present invention has been shown and described with respect to preferred embodiments, various changes and modifications within the scope of the invention will readily occur to those skilled in the art.

What is claimed is:

1. A method for estimating pitch of a speech signal comprising the steps of:

inputting a speech signal;

generating a plurality of pitch candidates corresponding to a plurality of sub-ranges within a pitch search range;

generating a first signal based on a segment of said speech signal;

generating a reference speech signal based on the first signal;

generating a synthetic speech signal for each of the plurality of pitch candidates; and comparing the synthetic speech signal for each of the plurality of pitch candidates with the reference speech signal to determine an optimal pitch estimate.

2. The method for estimating pitch of a speech signal as recited in claim 1, wherein said optimal pitch estimate is determined based on a synthetic speech signal for a pitch candidate that provides a maximum signal to noise ratio.

3. The method for estimating pitch of a speech signal as recited in claim 1, wherein said step of generating a reference speech signal comprises the substeps of:

inputting a speech signal;

generating a residual signal by linear predictive coding (LPC) inverse filtering a segment of the speech signal using LPC filter coefficients generated by LPC analysis of the segment of speech;

generating a residual spectrum by Fourier transforming the residual signal into the frequency domain;

analyzing the residual spectrum to determine amplitudes, frequencies and phases of peaks of the residual spectrum;

generating a reference residual signal from the peak amplitudes, frequencies and phases of the residual spectrum using sinusoidal synthesis; and generating a reference speech signal by LPC synthesis filtering the reference residual signal.

4. The method for estimating pitch of a speech signal as recited in claim 3, wherein said step of generating a synthetic speech signal for each of the plurality of pitch candidates comprises the substeps of:

determining the spectral shape of the residual spectrum;

sampling the spectral shape of the residual spectrum at the harmonics of each of the plurality of pitch candidates to determine harmonic components for each pitch candidate;

generating a synthetic residual signal for each pitch candidate from the harmonic components for each of the plurality of pitch candidates using sinusoidal synthesis; and generating a synthetic speech signal for each of the plurality of pitch candidates by LPC synthesis filtering the synthetic residual signal for each of the plurality of pitch candidates.

5. The method for estimating pitch of a speech signal as recited in claim 4, wherein said optimal pitch estimate is determined based on a synthetic speech signal for a pitch candidate that provides a maximum signal to noise ratio.

6. The method for estimating pitch of a speech signal as recited in claim 1, wherein said step of generating a synthetic speech signal for each of the plurality of pitch candidates comprises the substeps of:

determining the spectral shape of the residual spectrum;

sampling the spectral shape of the residual spectrum at the harmonics of each of the plurality of pitch candidates to determine harmonic components for each pitch candidate;

generating a synthetic residual signal for each pitch candidate from the harmonic components for each of the plurality of pitch candidates using sinusoidal synthesis; and generating a synthetic speech signal for each of the plurality of pitch candidates by LPC synthesis filtering the synthetic residual signal for each of the plurality of pitch candidates.

7. The method for estimating pitch of a speech signal as recited in claim 6, wherein said substep of generating a synthetic residual signal for each of the plurality of pitch candidates is performed based on the assumption that the speech signal is purely voiced.

8. A method for estimating pitch of a speech signal comprising the steps of:

inputting a speech signal;

determining a plurality of pitch candidates each corresponding to a sub-range within a pitch search range;

analyzing a segment of a speech signal using linear predictive coding (LPC) to generate LPC filter coefficients for the acoustic signal segment;

LPC inverse filtering the speech signal segment using the LPC filter coefficients to provide a residual signal which is spectrally flat;

transforming the residual signal into the frequency domain to generate a residual spectrum;

analyzing the residual spectrum to determine peak amplitudes and corresponding frequencies and phases of the residual spectrum;

generating a reference residual signal from the peak amplitudes, frequencies and phases of the residual spectrum using sinusoidal synthesis;

generating a reference speech signal by LPC synthesis filtering the reference residual signal;

performing harmonic sampling for each of the plurality of pitch candidates to determine the harmonic components for each of the plurality of the plurality of pitch candidates;

generating a synthetic residual signal for each of the plurality of pitch candidates from the harmonic components for each of the plurality of pitch candidates using sinusoidal synthesis;

LPC synthesis filtering the synthetic residual signal for each of the plurality of pitch candidates to generate a synthetic speech signal for each of the plurality of pitch candidates; and comparing each of the synthetic speech signal for each of the plurality pitch candidates with the reference residual signal to determine an optimal pitch estimate based on a synthetic speech signal for a pitch that provides a maximum signal to noise ratio.

* * * * *